US005570083A

United States Patent [19]

Johnson

[11] Patent Number: 5,570,083

[45] Date of Patent: Oct. 29, 1996

[54] DOOR BELL/ANSWERING SYSTEM

[76] Inventor: Lee A. Johnson, 2515 Crestline Ct., Lawrence, Kans. 66047

[21] Appl. No.: 434,351

[22] Filed: May 2, 1995

[51] Int. Cl.[6] ..... G08B 25/08

[52] U.S. Cl. ..... 340/692; 340/326; 340/330

[58] Field of Search ..... 340/326, 330, 340/328, 692, 825.31, 825.32, 392.1, 393.3, 327, 329; 379/67, 103, 167, 176; 369/22

[56] References Cited

U.S. PATENT DOCUMENTS

| | | | |
|---|---|---|---|
| D. 339,130 | 9/1993 | Johnson | D14/141 |
| 3,938,120 | 2/1976 | O'Connell | 340/692 |
| 3,964,058 | 6/1976 | Winston | 340/326 |
| 4,023,151 | 5/1977 | Markham | 340/692 |
| 4,100,581 | 7/1978 | Slack et al. | 340/692 |
| 4,275,274 | 6/1981 | English | 340/692 |
| 4,868,540 | 9/1989 | Housley | 340/326 |
| 5,148,468 | 9/1992 | Marrick et al. | 379/67 |
| 5,210,520 | 5/1993 | Housley | 340/326 |
| 5,210,528 | 5/1993 | Schulman | 340/692 |

FOREIGN PATENT DOCUMENTS

| | | |
|---|---|---|
| 685092 | 4/1930 | France . |
| 3400157 | 11/1985 | Germany . |

*Primary Examiner*—Thomas Mullen
*Assistant Examiner*—Daniel J. Wu
*Attorney, Agent, or Firm*—Chase & Yakimo

[57] ABSTRACT

A door bell system presents a normal door bell alarm with an alternative speech record/playback assembly. Upon depression of the exterior button extending through an exterior housing adjacent a building entrance the system with either energize the door bell or urge the visitor to leave a recorded message for subsequent playback. The door bell and/or record modes are selected by the user by a switch located within an interior housing mounted adjacent a building entrance. The housings include the appropriate components and wiring to provide the door bell and record/playback functions.

7 Claims, 9 Drawing Sheets

DOOR BELL/ANSWERING SYSTEM

BACKGROUND OF THE INVENTION

This invention relates to a door bell system and, more particularly, to a system mounted adjacent a door which will either function as a door bell or record messages of a visitor when the building occupant is absent or otherwise unavailable.

The use of intercoms, peepholes, etc., have been proposed to enable a building occupant to ascertain the identity of a visitor at the door. One proposed system identified as an automatic door information system plays a prerecorded message when the door bell button is pushed. The caller is then invited to state a message if the occupant is present or to leave a recorded message for subsequent playback.

One problem with such a device is that the normal door bell function is not available. Thus, a building occupant will not know when a visitor is at the door. If the occupant is unaware of the visitor's presence, the visitor may leave before the occupant answers the door. Accordingly, it is desirable to have a system which provides either selectable door bell or recording modes.

In response thereto I have invented a door bell system which enables a home occupant to either utilize the system's door bell function or to urge the visitor to record a message on an internal record and playback speech module. Thus, upon pushing the door bell button, the visitor will either ring the door bell or will be urged by external indicia, such as a warning light or prerecorded message, to leave a recorded message. The building occupant is provided with a switch on the interior of the building which enables the occupant to selectably use the device in its door bell or record modes.

It is therefore a general object of this invention to provide a door bell system which has door bell and message record/playback modes.

It is another object of this invention to provide a device, as aforesaid, which allows the occupant to select the door bell or record/playback modes.

Still a further object of this invention is to provide a device, as aforesaid, which enables the occupant to receive and playback recorded messages.

A further object of this invention is to provide a device, as aforesaid, which provides external indicia to urge a visitor to record a message.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
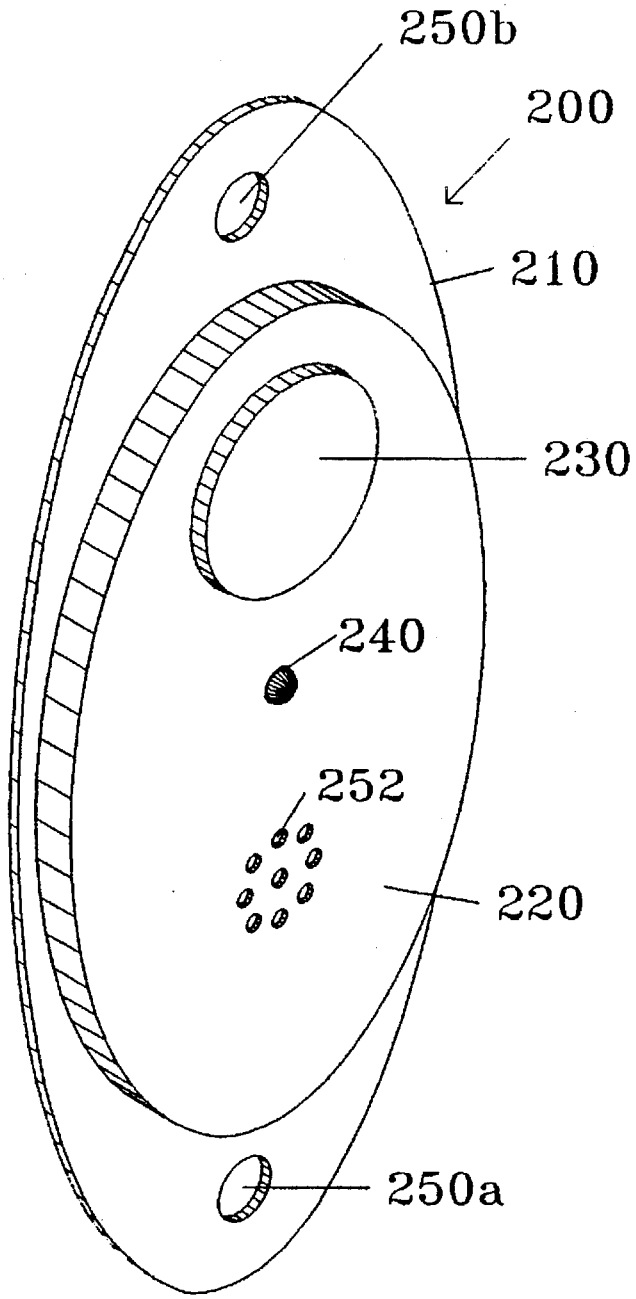
FIG. 1 is a perspective view of the system's housing for attachment to the exterior side of the building.
Figure 2:
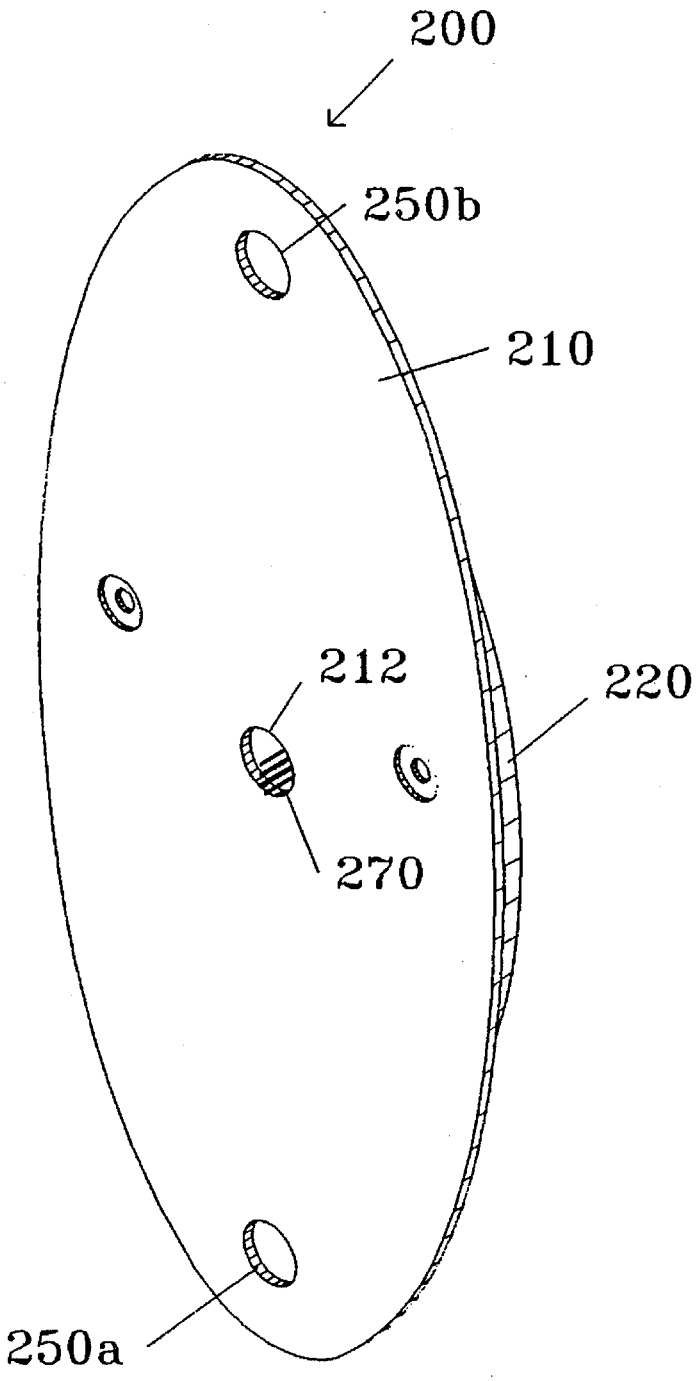
FIG. 2 is a rear view of the housing shown in FIG. 1.

Turning more particularly to the drawings, FIG. 1 shows the system's exterior housing 200 as comprising a back plate 210 having mounting apertures 250*a*, 250*b* therein. The plate 210 is attached to the exterior surface of the building at a door-adjacent position by screw fasteners or the like. Atop plate 210 is a cover 220 having a push button 230, LED 240 and microphone apertures 242 therein.

Figure 3:
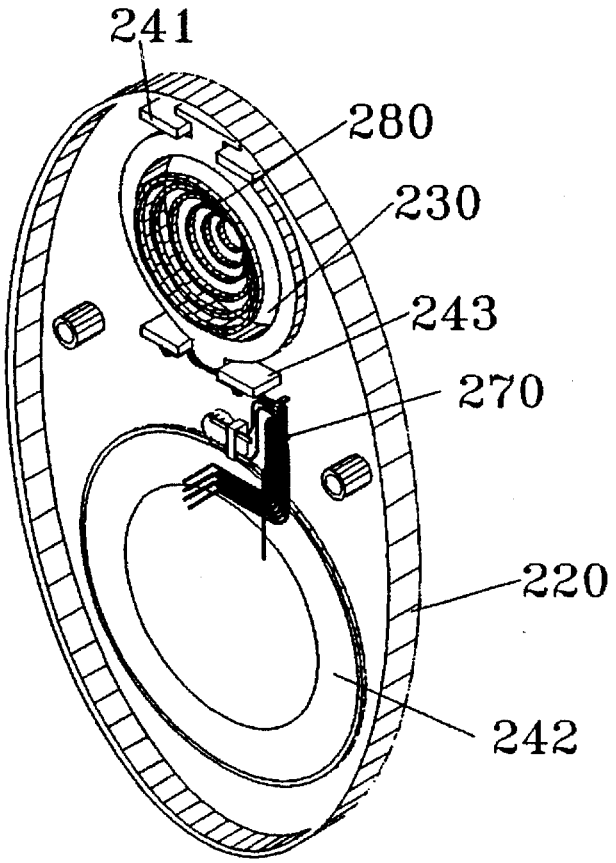
FIG. 3 is a rear view of the housing of FIG. 2 with the back plate removed for showing the various elements therein.
Figure 4:
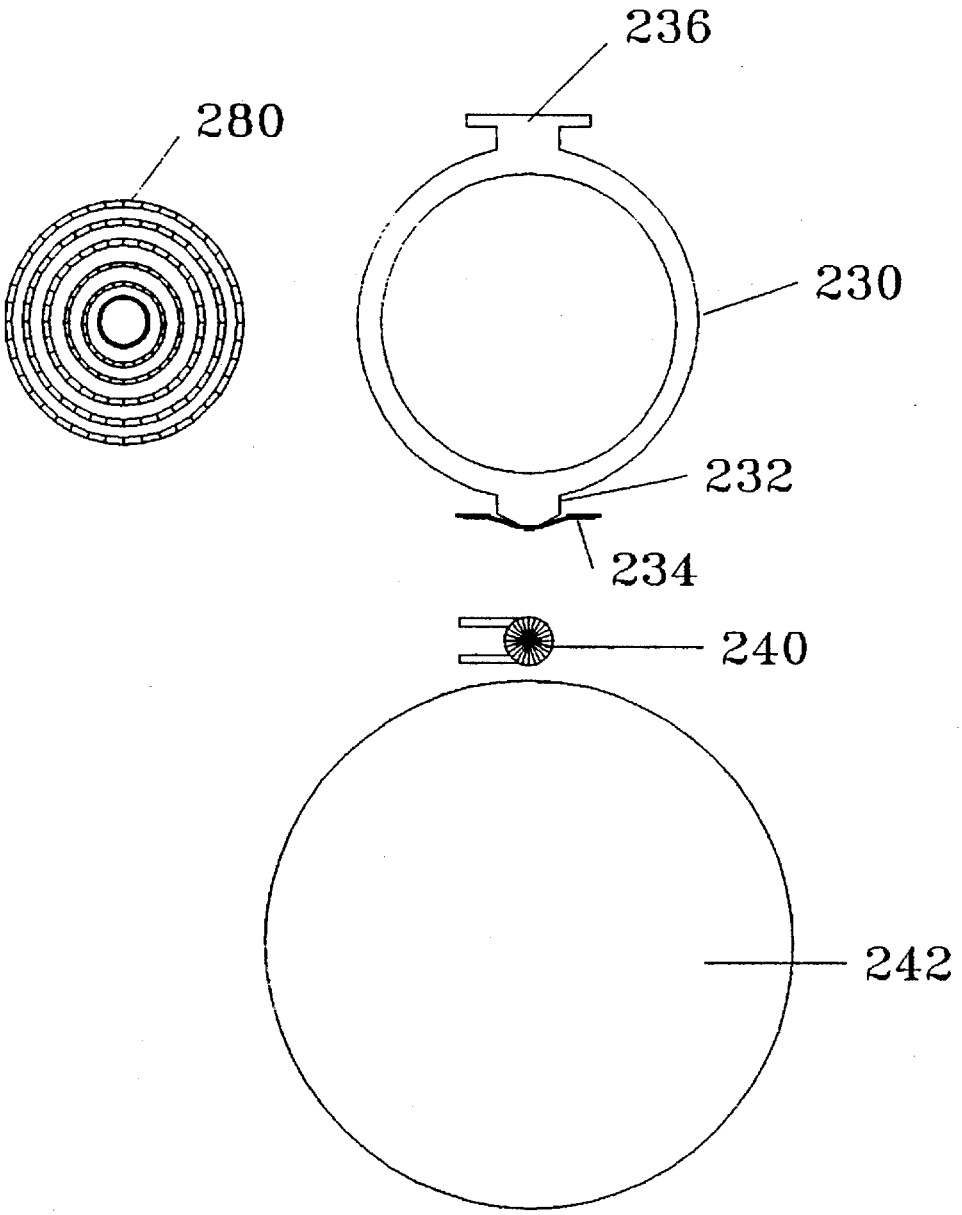
FIG. 4 is a view of the elements utilized in the exterior FIG. 1 housing.

Located within the cover 220, as shown in FIGS. 3, 4, is a spring 280 which urges the seated button 230 into extension through the cover 220. Extending from the bottom of button 230 is a lobe 232 with contact 234 so as to energize the appropriate circuit upon depression of button 230. A mounting flange 236 extends from the upper end of button 230. Lobe 232 and flange 236 extend between guides 241, 243 located within cover 220. A wire array 270 presents a free end adjacent contact 234 and extends through an aperture 212 in back plate 210 for extension to the interior housing 300, as to be subsequently described. Wires within array 270 are also connected to microphone 242 which seats within the cover 220.

Figure 5:
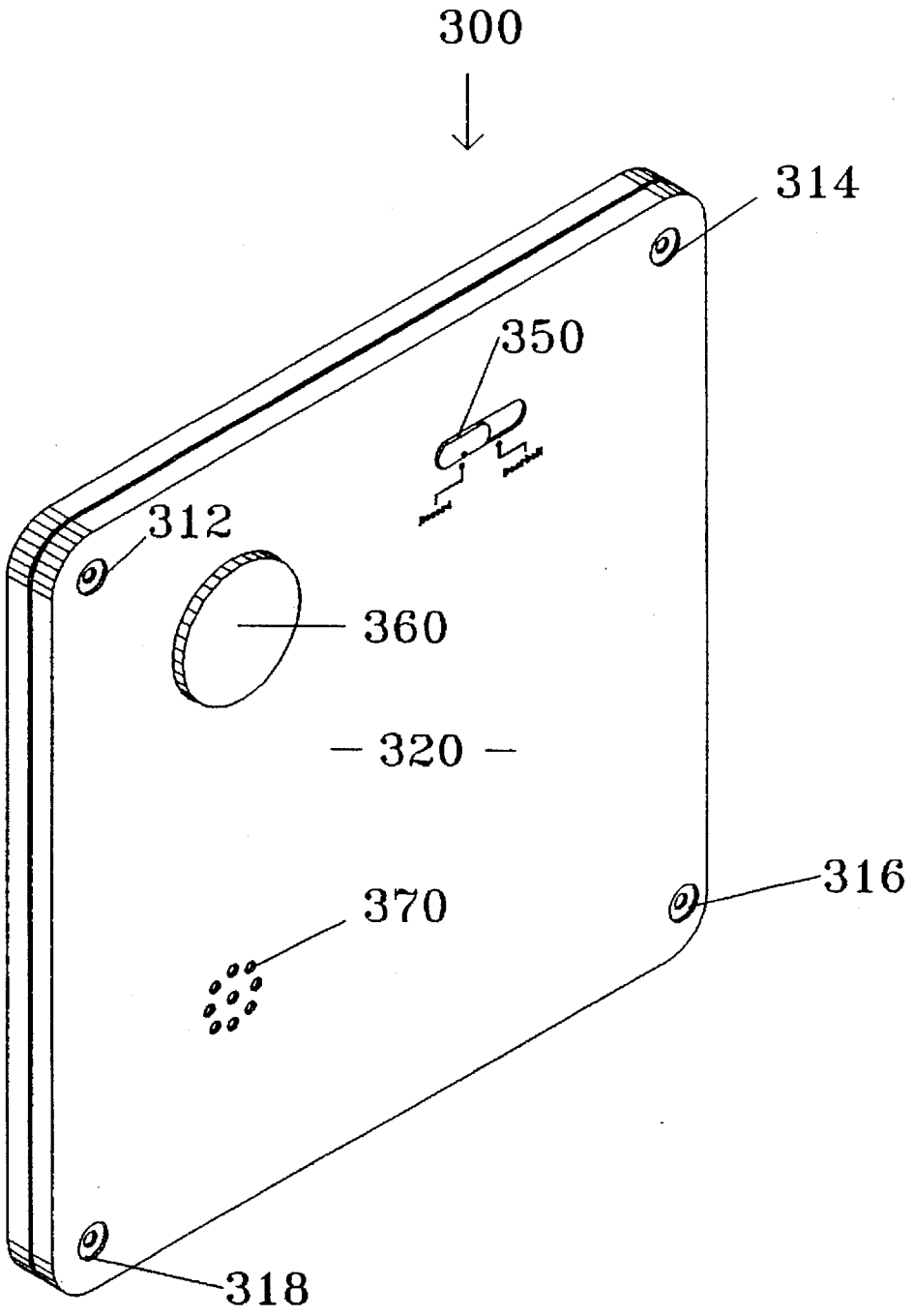
FIG. 5 is a front perspective view of the system's interior housing for attachment to the interior side of the building.
Figure 6:
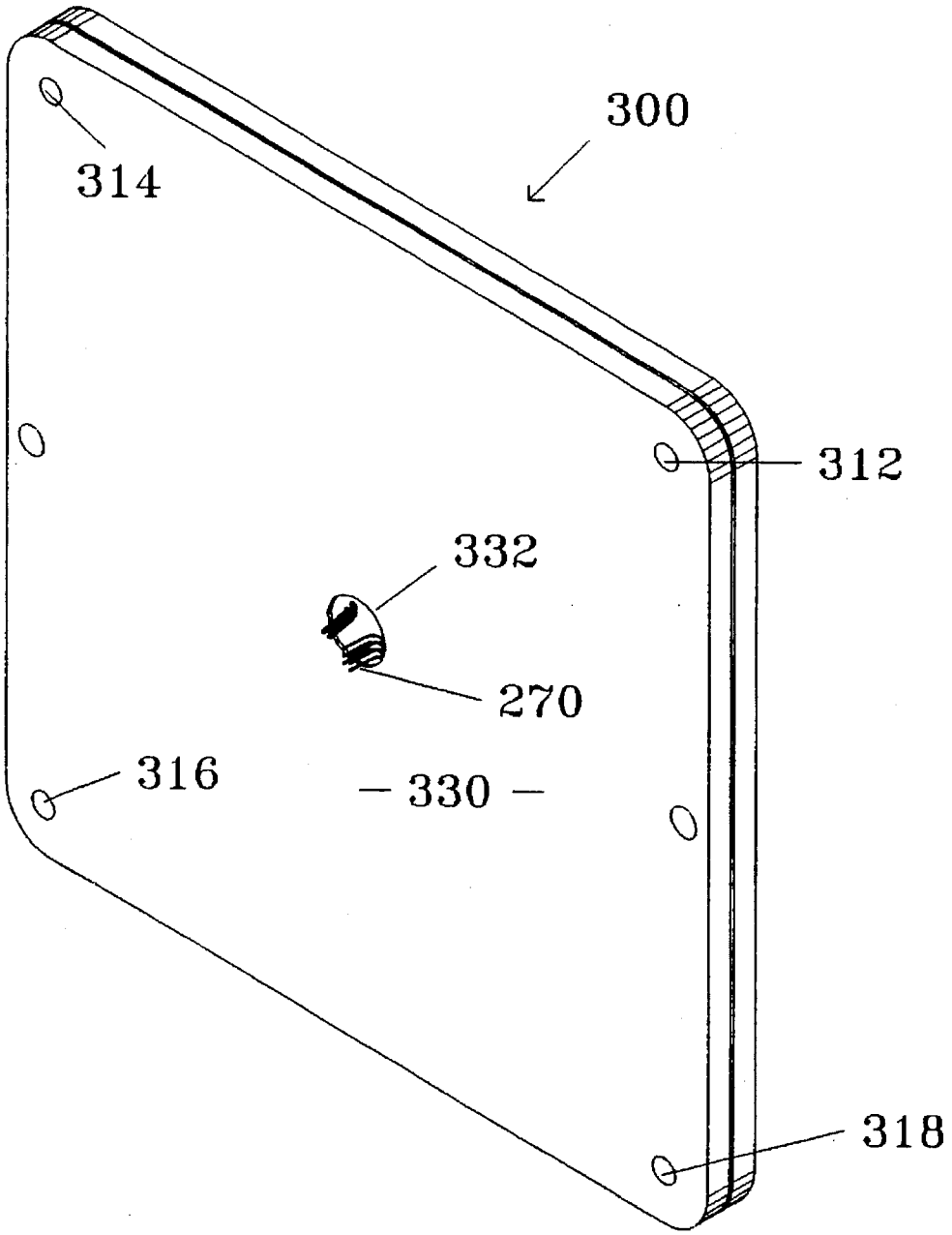
FIG. 6 is a rear view of the housing of FIG. 5.
Figure 7:
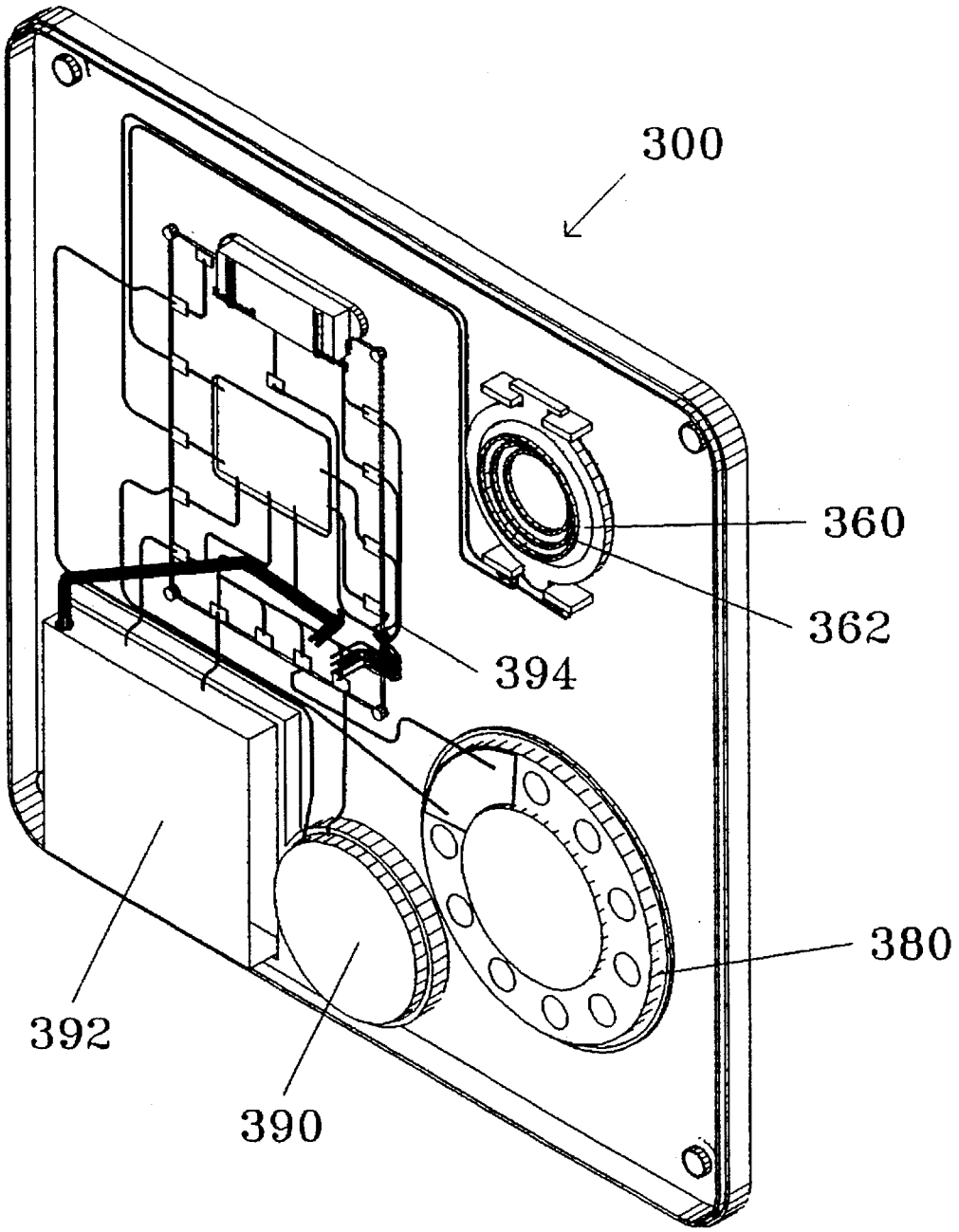
FIG. 7 is a rear view of the housing of FIG. 5 with back cover removed to show the various components therein.
Figure 8:
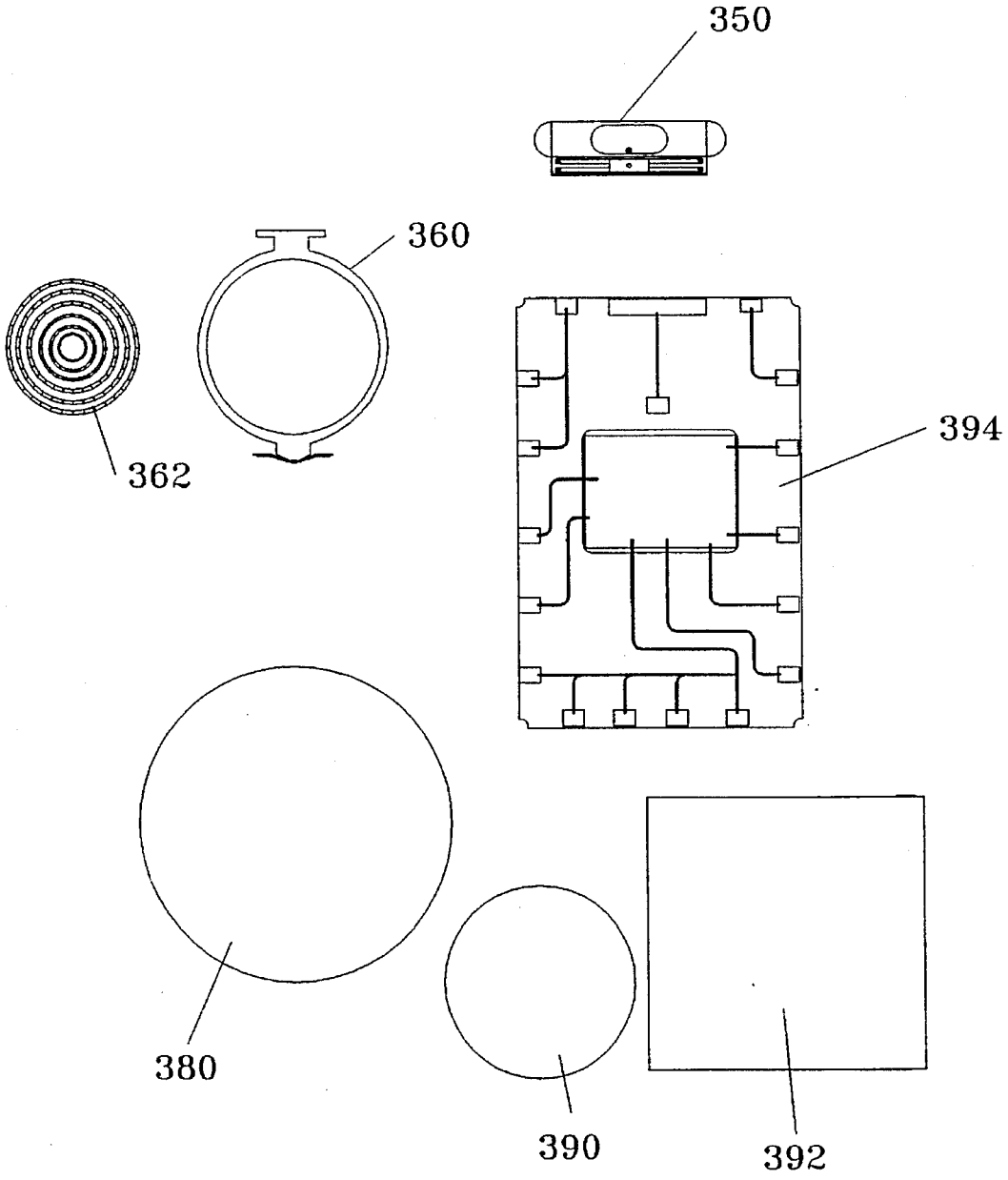
FIG. 8 is a view of the elements utilized in the interior FIG. 5 housing.

An interior housing 300 is as shown in FIGS. 5–7 and includes apertures 312, 314, 316, 318 at the corners thereof for extension of fasteners therethrough and attachment to an interior wall surface. Located in the wall adjacent surface 330 of housing 300 is an aperture 332 for extension of the above wire array into this interior housing 300. The front surface 320 of housing presents a mode selection switch 350, a message playback button 360 and speaker ports 370.

Seated within the front panel 320 of housing 300 are a piezo speaker 380, a buzzer 390, power supply 392 and an IC speech/playback module 394. The power supply may be either an internal DC battery or include means to transform the AC house current to a DC voltage. Appropriate wiring 270 extend between the components in the housings 200, 300 so as to present circuit with the buzzer 390, speaker 380, a spring biased 362 playback button 360, record button 230, LED 240 and microphone 242 selectably interposed therein.

Figure 9:
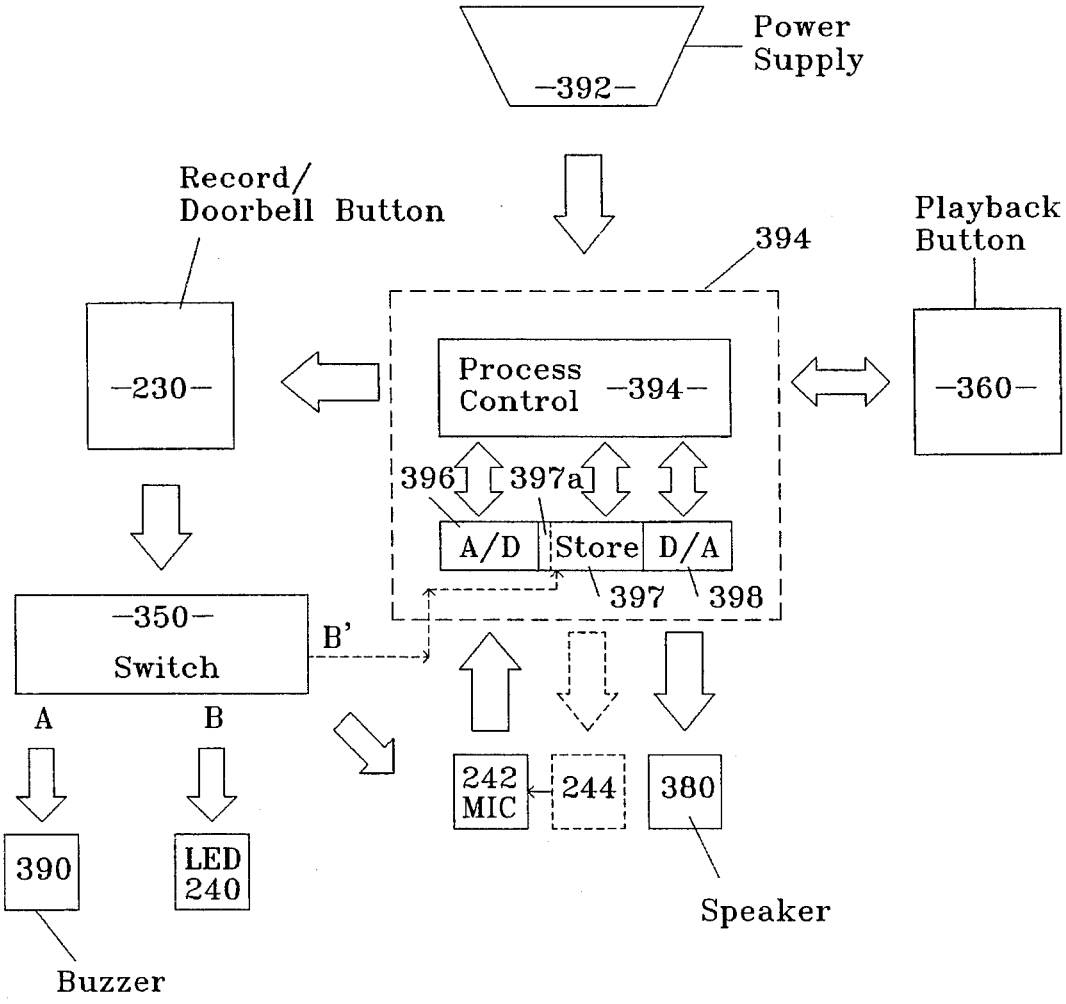
FIG. 9 is a block diagram diagrammatically showing the system functions and in phantom lines an alternative modification of the system.

The circuitry is wired to provide the functions as diagrammatically shown in FIG. 9. The IC record/playback chip 394 includes process control logic 395 for converting analog speech into digital form 396, storing the digital data at 397 and then converting the stored digital data to an analog format 398. The module 394 is energized either by depression of the record 230 or playback 360 buttons.

Upon the mode switch 350 being moved to the door bell mode, depression of the exterior button 230 by a building visitor will cause only the buzzer 390 to sound. If the switch is moved to the alternative record mode, the buzzer 390 will not sound but the LED 240 will glow. Indicia in the form of written instructions adjacent the LED 240 will urge the visitor to speak into the microphone apertures 242 so as to record a message for storage in module 394. This message is then stored at 397 for subsequent playback to the home occupant upon depression of the interior playback button 360.

Alternatively, as shown in phantom lines, the module 394 may include a prerecorded speech module 397*a* within storage 397 which will play a verbal message to the visitor upon depression of door bell button 230. The message will urge the visitor to speak into the microphone 242. In such a case, the instructional plate need not be utilized adjacent the LED 240. However, a speaker 244 needs to be placed within cover 220 and appropriately wired so that the visitor may hear the prerecorded message.

Accordingly, it can be seen that the selector switch 350 presents either a door bell mode or record mode to the building occupant. In the door bell mode the buzzer 390 will simply ring upon button 230 depression to indicate to the building occupant that someone is at the door. In the record mode the LED 240 will glow upon button 230 depression which will, along with supplemental verbal or written indicia, urge the visitor to leave a recorded message via microphone 242 for subsequent playback by the building occupant. Thus, the problems of past devices are avoided.

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A door bell system comprising:

a first housing;

means for mounting said first housing to an exterior surface of a building adjacent a building entrance;

a second housing;

means for mounting said second housing to an interior surface of a building at an entrance position;

an electronic circuit within said first and second housings and including:

a biased button extending from said first housing;

an LED extending through said first housing;

a microphone in said first housing;

a speech module assembly in said second housing for recording and playback of a selected message;

a biased button extending from said second housing;

a buzzer in said second housing;

a speaker in said second housing;

a power source in said second housing for energizing said circuitry;

switch means in said second housing for selectably connecting said circuitry with either said buzzer or said speech module whereupon depression of said button in said first housing will either energize said buzzer or said LED; and indicia associated with said first housing whereby said energized LED urges a user to speak into said microphone and record a message in said speech module assembly.

2. The system as comprised in claim 1 wherein depression of said button in said second housing will cause a playback of a message recorded in said speech module assembly.

3. The system as claimed in claim 1 wherein said indicia comprises written instructions associated with said first housing.

4. The system as claimed in claim 1 wherein said indicia comprises a prerecorded message in said speech module assembly, whereupon depression of said button in said first housing will cause a playback of said prerecorded message.

5. A door bell system comprising:

a first housing;

means for mounting said first housing to an exterior surface of a building adjacent a building entrance;

a second housing;

means for mounting said second housing to an interior surface of a building at an entrance position;

an electronic circuit within said first and second housings and including:

a speech module assembly in said second housing for recording and playback of a message;

first alarm means in said first housing;

means in said first housing for recording a message in said speech module assembly;

a biased button extending from said first housing for energizing either a second alarm means in said second housing or said speech module;

means in said second housing for playing back a recorded message in said speech module assembly;

a biased button extending from said second housing for energizing said playback means;

switch means in said second housing for selectably connecting said circuit with either said second alarm means or said speech module, whereupon depression of said button in said first housing will either energize said first or said second alarm means, said energized first alarm means urging a user to record a message in said speech module assembly.

6. The system as claimed in claim 5 wherein said second alarm means is indicative to a building occupant of depression of said button extending from said first housing.

7. A door bell system comprising:

a first housing;

means for mounting said first housing to an exterior surface of a building adjacent a building entrance;

a second housing;

means for mounting said second housing to an interior surface of a building at an entrance position;

an electronic circuit within said first and second housings having a first mode including means for recording a message or a second mode including means for sounding a first alarm in said second housing upon operation by a person positioned exterior a building entrance and said first housing;

means in said housings for playing back said recorded message by a person positioned interior a building entrance;

switch means in said second housing operable by a person positioned adjacent said second housing for causing said circuit to operate in either said first or second modes; and second alarm means associated with said circuit and said first housing, said second alarm means operable with said recording means upon said circuit operating in said first mode.

* * * * *